US006431191B1

(12) United States Patent
Wang

(10) Patent No.: US 6,431,191 B1
(45) Date of Patent: Aug. 13, 2002

(54) UMBRELLA WITH AN IMPROVED RUNNER FASTENER

(76) Inventor: Max Wang, No. 19, Ta-Yuan 13th St., Tai-Ping City, Taichung Hsien (TW)

( * ) Notice: Subject to any disclaimer, the term of this patent is extended or adjusted under 35 U.S.C. 154(b) by 0 days.

(21) Appl. No.: 09/809,394

(22) Filed: Mar. 15, 2001

(51) Int. Cl.[7] ..... A45B 25/08

(52) U.S. Cl. ..... 135/40; 135/28; 135/38; 135/39; 135/20.3

(58) Field of Search ..... 135/28, 37, 38, 135/39, 40, 41, 20.3

(56) References Cited

U.S. PATENT DOCUMENTS

| | | | | | |
|---|---|---|---|---|---|
| 3,156,249 | A | * | 11/1964 | Biderman | 135/15.1 |
| 3,856,032 | A | * | 12/1974 | Schafer | 135/28 |
| 5,088,512 | A | * | 2/1992 | Chou et al. | 135/24 |
| 5,732,725 | A | * | 3/1998 | Ko | 135/28 |
| 5,740,824 | A | * | 4/1998 | Tang | 135/28 |
| 5,911,233 | A | * | 6/1999 | Wu | 135/28 |
| 6,006,771 | A | * | 12/1999 | Wu | 135/28 |

FOREIGN PATENT DOCUMENTS

| | | | |
|---|---|---|---|
| EP | 493867 | * | 7/1992 |
| GB | 931810 | * | 7/1963 |
| IT | 504324 | * | 12/1954 |
| IT | 543342 | * | 5/1956 |

* cited by examiner

*Primary Examiner*—Carl D. Friedman
*Assistant Examiner*—Winnie Yip
(74) *Attorney, Agent, or Firm*—Webb Ziesenheim Logsdon Orkin & Hanson, P.C.

(57) ABSTRACT

An umbrella includes a runner sleeved slidably on a stem for spreading and collapsing a canopy which is mounted on a ferrule. A tubular member surrounds the stem, is fixed on the ferrule, and is formed with a retaining slot therein. An upper end portion of the runner is formed with a through hole which is aligned with the retaining slot longitudinally, and which can be registered with the same radially when the runner is moved to stretch the canopy. A lever member is pivoted to the runner at a fulcrum portion, and has upper and lower segments at two opposite sides of the fulcrum portion. The upper segment has an anchoring end portion to be received and retained in the retaining slot by the action of a biasing member when the canopy is stretched.

3 Claims, 5 Drawing Sheets

UMBRELLA WITH AN IMPROVED RUNNER FASTENER

BACKGROUND OF THE INVENTION

1. Field of the Invention

This invention relates to an umbrella, more particularly to an umbrella with an improved runner fastener which is provided on a stem without weakening the structural strength of the same.

2. Description of the Related Art

Referring to FIG. 1, a conventional umbrella is shown to include an elongate stem 1 with an upper elongate hole 101 in which a spring-loaded stop 2 is provided. A runner 3 is sleeved slidably on the stem 1 to connect pivotally with a stretcher assembly (not shown) to support a rib assembly (not shown) which is mounted on an upper end of the stem 1. The runner 3 is movable along the stem 1 between an upper position for stretching the rib assembly and a lower position for collapsing the same. At the upper position, the runner 3 is retainingly supported by the stop 2.

In view of the fact that the stem 3 of the conventional umbrella should be made hollow to receive the spring-loaded stop 2, it was not contemplated to provide a solid structure for the stem. Due to this inherent limitation of the stem, which is a primary part of the umbrella in terms of strength, it is quite difficult to further improve the rigidity of the stem, and hence the durability of the umbrella.

SUMMARY OF THE INVENTION

The object of the present invention is to provide an umbrella which can overcome the aforementioned problems commonly associated with the prior art.

According to this invention, the umbrella includes an elongate stem which extends along an axis, and which has a first upper end portion, a first lower end portion, and a middle portion therebetween. A ferrule is fixed on the first upper end portion of the stem. A tubular member surrounds the first upper end portion of the stem about the axis, and includes a second upper end portion which is fixed to the ferrule, and a second lower end portion which extends downwardly from the second upper end portion, and which is formed with a retaining slot that extends in a radial direction radial to the axis. A canopy is mounted on the first upper end portion of the stem. A rib assembly is disposed at an underside of the canopy to support the canopy in a spread-out position and in a collapsed position. A tubular runner is sleeved slidably on the stem, and has third upper and lower end portions respectively proximate and distal to the ferrule, and an intermediate portion therebetween. The runner is movable between upper and lower positions respectively corresponding to the spread-out and collapsed positions of the canopy. A stretcher assembly is disposed to interconnect the intermediate portion of the runner and the rib assembly so as to stretch or retract the rib assembly to put the canopy in the spread-out or collapsed position when the runner is moved to the upper or lower position, respectively. The third upper end portion of the runner is formed with a through hole which is aligned with the retaining slot in a longitudinal direction parallel to the axis, and which extends therethrough in the radial direction. The third upper end portion of the runner can be brought to surround the tubular member and to have the through hole registering with the retaining slot when the runner is in the upper position. A lever member defines a fulcrum portion which is pivoted to the intermediate portion of the runner about a pivot axis transverse to the longitudinal direction, and has upper and lower segments which are disposed at two opposite ends of the fulcrum portion and which are opposite to each other in the longitudinal direction. The upper segment has an anchoring end portion which extends radially and inwardly of the third upper end portion of the runner through the through hole and which is of such a dimension so as to be received and retained in the retaining slot when the runner is in the upper position. A biasing member is disposed to bias the anchoring end portion radially and inwardly toward the stem.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
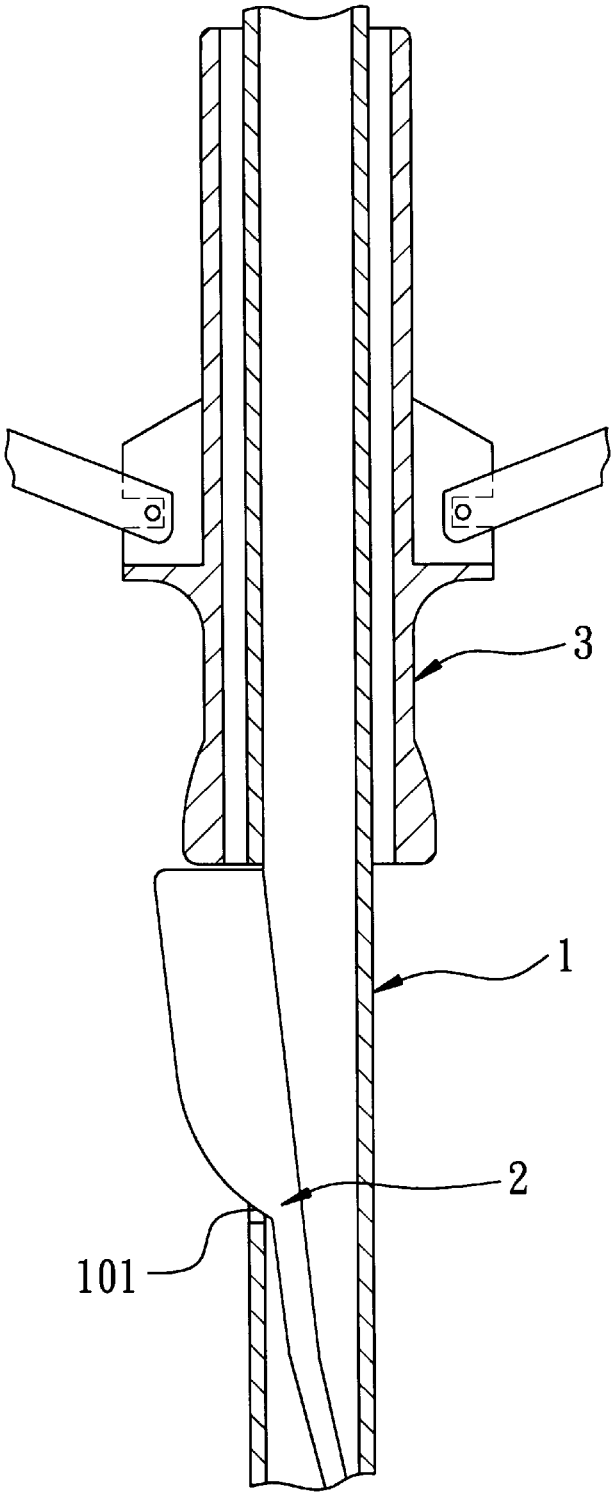
FIG. 1 PRIOR ART
FIG. 1 is a schematic view of a runner fastener of a conventional umbrella.
Figure 2:
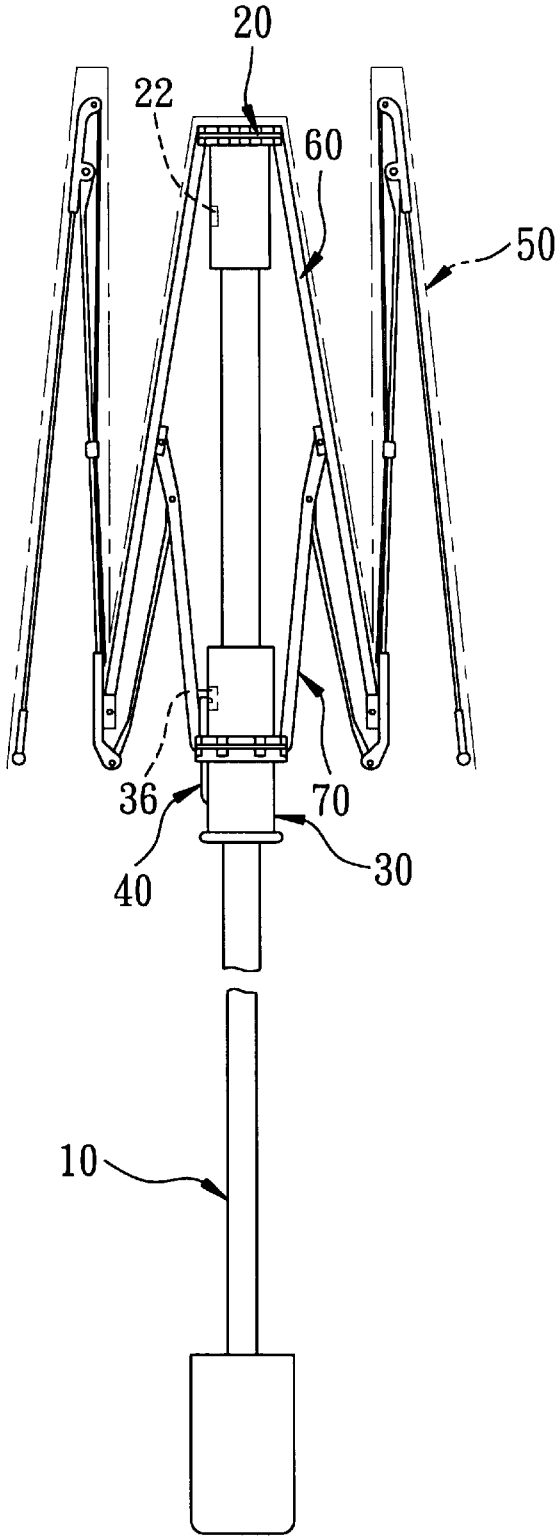
FIG. 2 is a schematic view of a preferred embodiment of an umbrella according to this invention.
Figure 3:
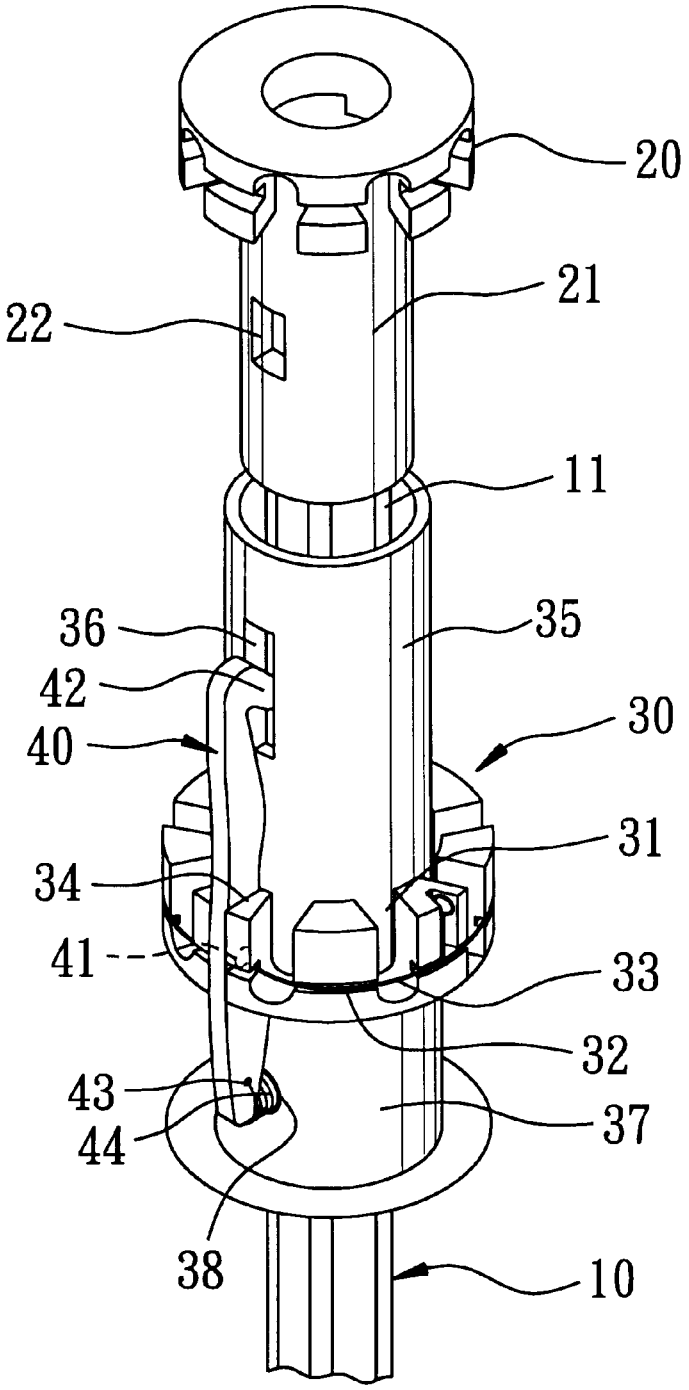
FIG. 3 is a perspective view of a runner fastener of the preferred embodiment.

Referring to FIGS. 2 and 3, the preferred embodiment of the umbrella according to the present invention is shown to comprise an elongate stem 10 which extends along an axis, and which has a first upper end portion 11, a first lower end portion, and a middle portion therebetween. A ferrule 20 is fixed on the first upper end portion 11 of the stem 10. A tubular member 21 is disposed to surround the first upper end portion 11 of the stem 10 about the axis, and includes a second upper end portion fixed to the ferrule 20, and a second lower end portion which extends downwardly from the second upper end portion, and which is formed with a retaining slot 22 that extends in a radial direction radial to the axis. A canopy 50 is mounted on the first upper end portion 11 of the stem 10. A rib assembly 60 is disposed at an underside of the canopy 50 to support the canopy 50 in a spread-out position and in a collapsed position. A tubular runner 30 is sleeved slidably on the stem 10, and has third upper and lower end portions 35,37 respectively proximate and distal to the ferrule 20, and an intermediate portion therebetween. The runner 30 is movable between upper and lower positions which respectively correspond to the spread-out and collapsed positions of the canopy 50. A stretcher assembly 70 is disposed to interconnect the intermediate portion of the runner 30 and the rib assembly 60 so as to stretch or retract the rib assembly 60 to put the canopy 50 in the spread-out or collapsed position when the runner 30 is moved to the upper or lower position, respectively. The third upper end portion 35 of the runner 30 is formed with a through hole 36 which is aligned with the retaining slot 22 in a longitudinal direction parallel to the axis, and which extends therethrough in the radial direction. The third upper end portion 35 of the runner 30 has an inner diameter sufficient so as to bring the same to surround the tubular member 21 and to have the through hole 36 registering with the retaining slot 22 when the runner 30 is in the upper position. The intermediate portion of the runner 30 is formed with a plurality of pivot slots 31 which are displaced angularly from each other about the axis for receiving a plurality of pivot ends of the stretcher assembly 70. A ring member 33 is disposed in to surround fixedly an annular groove 32 in the intermediate portion of the runner 30 such that the pivot ends of the stretcher assembly 70 are mounted pivotally thereon in a known manner.

Figure 4:
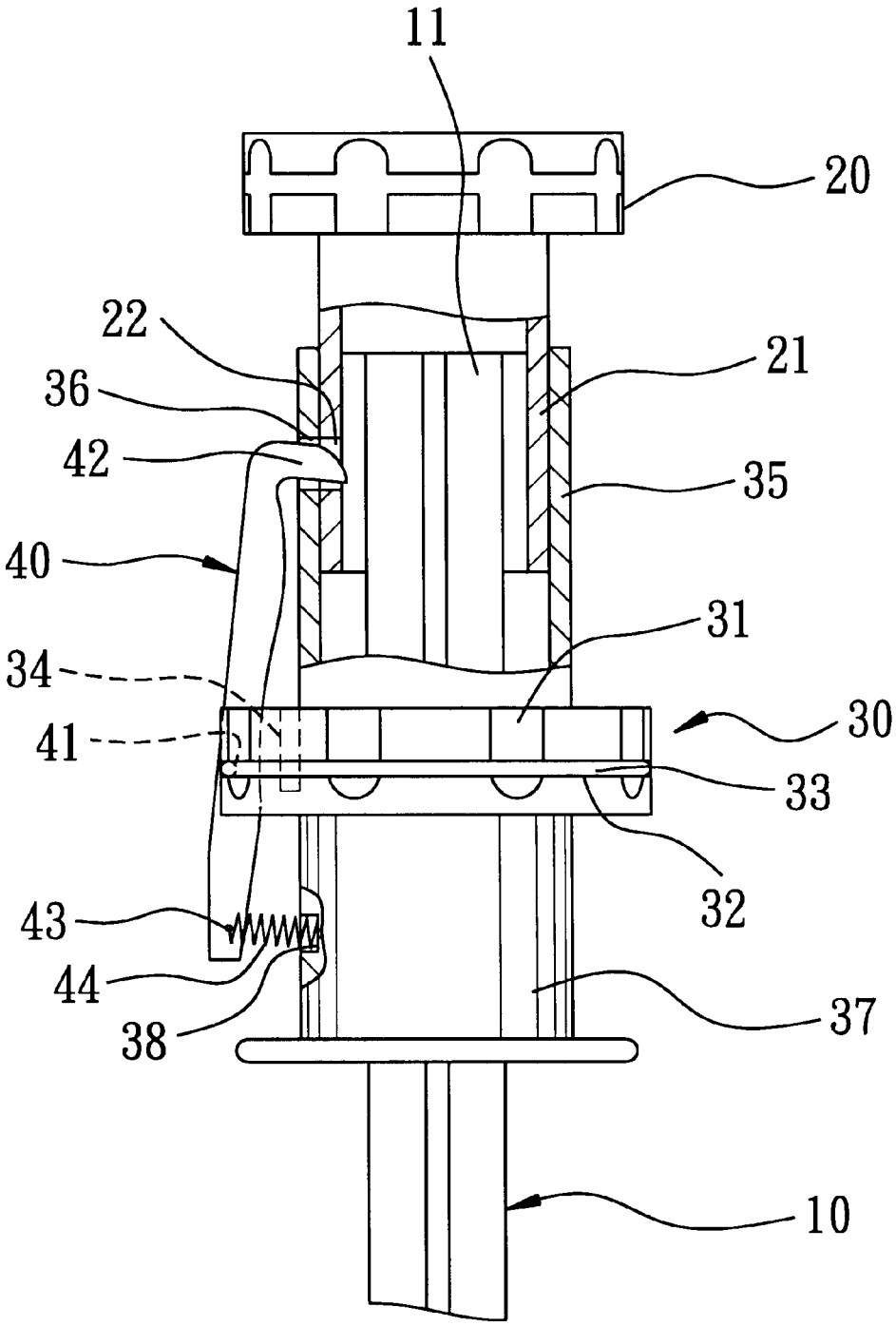
FIG. 4 is a sectional view showing the runner fastener in an engaged state.
Figure 5:
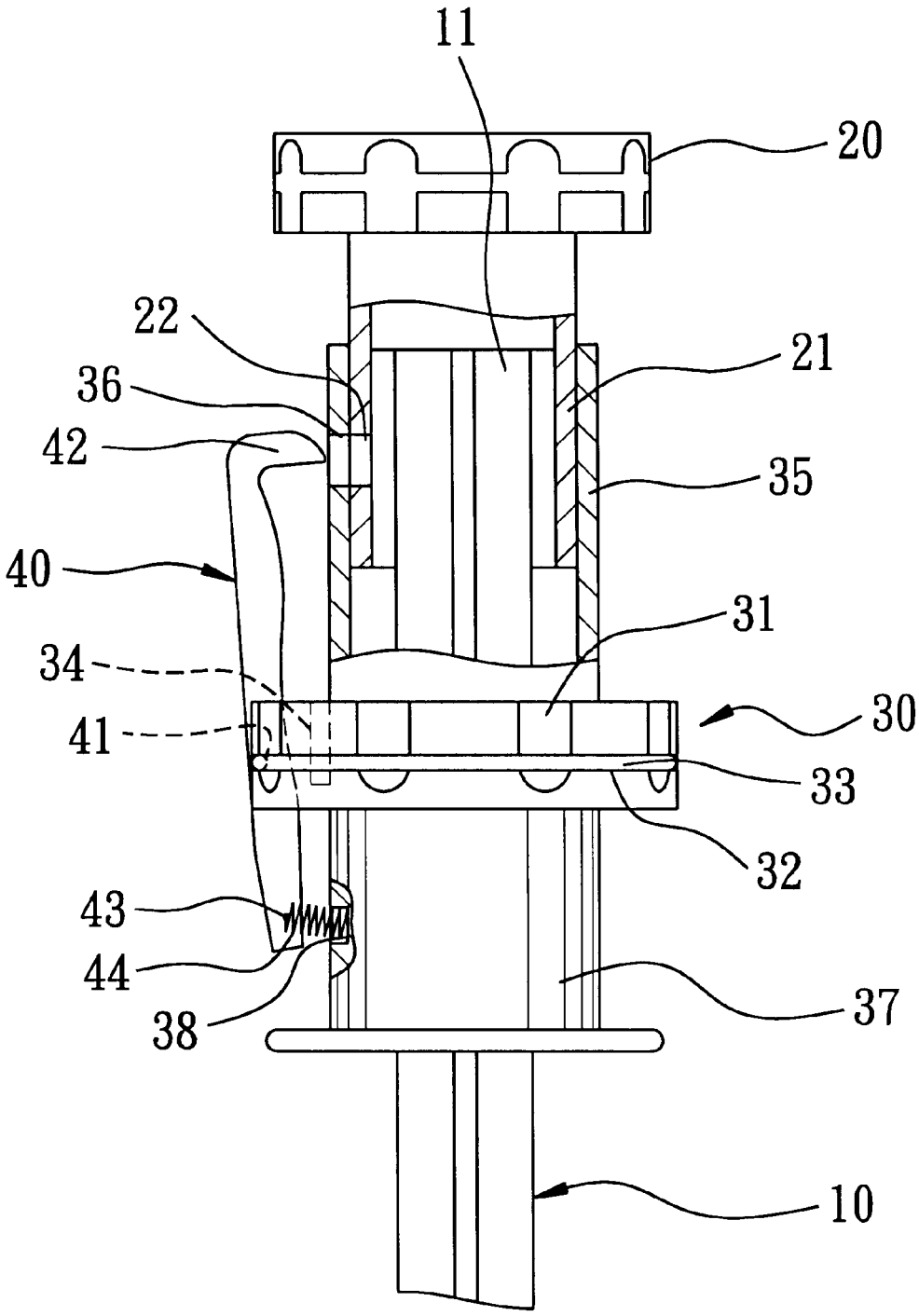
FIG. 5 is a sectional view showing the runner fastener in a disengaged state.

A recess 34 is formed on the intermediate portion of the runner 30 and extends in the longitudinal direction. A lever member 40 defines a fulcrum portion 41 which is pivoted to the intermediate portion of the runner 30 at the recess 34 about a pivot axis transverse to the longitudinal direction, and has upper and lower segments which are disposed at two opposite ends of the fulcrum portion 41 and which are opposite to each other in the longitudinal direction. The upper segment has an anchoring end portion 42 which extends radially and inwardly of the third upper end portion 35 of the runner 30 through the through hole 36. As such, referring to FIG. 4, when the runner 30 is in the upper position, the anchoring end portion 42 can be received and retained in the retaining slot 22 to keep the canopy 50 in the spread-out position. Furthermore, two cavities 38,43 are formed respectively in the third lower end portion 37 of the runner 30 and the lower segment of the lever member 40 and are opposite to each other in the radial direction such that a biasing member 44, such as a compression spring, is disposed between the cavities 38,43 so as to bias the lower segment outwardly and radially in order to turn the anchoring end portion 42 of the upper segment radially and inwardly toward the stem 10. Thus, as shown in FIG. 5, when the user presses the lower segment of the lever member 40 against the biasing force of the biasing member 44, the anchoring end portion 42 of the upper segment is turned outwardly and radially to disengage from the retaining slot 22 and the through hole 36, thereby permitting movement of the runner 30 to the lower position so as to collapse the umbrella.

Therefore, as compared to the conventional umbrella, there is no need to form a hole in the stem 10 according to the umbrella of this invention, thereby maintaining the structural strength of the stem 10.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. An umbrella comprising:

an elongate stem extending along an axis, and having a first upper end portion, a first lower end portion, and a middle portion therebetween;

a ferrule fixed on said first upper end portion of said stem;

a tubular member surrounding said first upper end portion of said stem about the axis, and including a second upper end portion which is fixed to said ferrule, and a second lower end portion which extends downwardly from said second upper end portion, and which is formed with a retaining slot that extends in a radial direction radial to the axis;

a canopy mounted on said first upper end portion of said stem;

a rib assembly disposed at an underside of said canopy to support said canopy in a spread-out position and in a collapsed position;

a tubular runner sleeved slidably on said stem, and having third upper and lower end portions respectively proximate and distal to said ferrule, and an intermediate portion therebetween, said runner being movable between upper and lower positions respectively corresponding to the spread-out and collapsed positions of said canopy;

a stretcher assembly disposed to interconnect said intermediate portion of said runner and said rib assembly so as to stretch or retract said rib assembly to put said canopy in the spread-out or collapsed position when said runner is moved to the upper or lower position, respectively;

wherein said third upper end portion of said runner is formed with a through hole which is aligned with said retaining slot in a longitudinal direction parallel to the axis, and which extends therethrough in the radial direction, and has an inner diameter sufficient so as to be brought to surround said tubular member and to have said through hole registering with said retaining slot when said runner is in the upper position;

a lever member defining a fulcrum portion pivoted to said intermediate portion of said runner about a pivot axis transverse to the longitudinal direction, and having upper and lower segments disposed at two opposite ends of said fulcrum portion and opposite to each other in the longitudinal direction, said upper segment having an anchoring end portion which extends radially and inwardly of said third upper end portion of said runner through said through hole and which is of such a dimension so as to be received and retained in said retaining slot when said runner is in the upper position; and a biasing member disposed to bias said anchoring end portion radially and inwardly toward said stem.

2. The umbrella of claim 1, wherein said biasing member is a compression spring which is disposed between said third lower end portion of said runner and said lower segment and which extends in the radial direction to bias said lower segment outwardly and radially so as to turn said upper segment inwardly and radially.

3. The umbrella of claim 1, wherein said runner further includes a ring member fixedly surrounding said intermediate portion, said stretcher assembly including a plurality of pivot ends which are pivotally mounted on said ring member and which are displaced angularly from each other about the axis, said fulcrum portion of said lever member being pivoted on said ring member.

* * * * *